US009587650B2

(12) United States Patent
Yamada et al.

(10) Patent No.: US 9,587,650 B2
(45) Date of Patent: Mar. 7, 2017

(54) EJECTOR

(71) Applicant: DENSO CORPORATION, Kariya, Aichi-pref. (JP)

(72) Inventors: Etsuhisa Yamada, Kariya (JP); Haruyuki NIshijima, Obu (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 190 days.

(21) Appl. No.: 14/382,676

(22) PCT Filed: Feb. 21, 2013

(86) PCT No.: PCT/JP2013/000965

§ 371 (c)(1),
(2) Date: Sep. 3, 2014

(87) PCT Pub. No.: WO2013/132768

PCT Pub. Date: Sep. 12, 2013

(65) Prior Publication Data

US 2015/0023809 A1 Jan. 22, 2015

(30) Foreign Application Priority Data

Mar. 7, 2012 (JP) ..... 2012-050830

(51) Int. Cl.
*F04F 5/20* (2006.01)
*F04F 5/46* (2006.01)
(Continued)

(52) U.S. Cl.
CPC ..... *F04F 5/20* (2013.01); *F04F 5/16* (2013.01); *F04F 5/24* (2013.01); *F04F 5/46* (2013.01);
(Continued)

(58) Field of Classification Search
CPC ..... F04F 5/20; F04F 5/16; F04F 5/24; F04F 5/50; F04F 5/46; F04F 5/463; Y10T 137/2224
See application file for complete search history.

(56) References Cited

U.S. PATENT DOCUMENTS

2008/0310970 A1* 12/2008 Fenton ..... F04F 5/14 417/198
2009/0013704 A1* 1/2009 Oshitani ..... F25B 41/00 62/191
2009/0229304 A1 9/2009 Ogata et al.

FOREIGN PATENT DOCUMENTS

JP S5990621 A 5/1984
JP H04087329 U 7/1992
(Continued)

OTHER PUBLICATIONS

Office Action dated Dec. 2, 2014 in corresponding Japanese Application No. 2012-050830.
(Continued)

*Primary Examiner* — Charles Freay
*Assistant Examiner* — Philip Stimpert
(74) *Attorney, Agent, or Firm* — Harness, Dickey & Pierce, P.L.C.

(57) ABSTRACT

An ejector includes a nozzle having a fluid passage circular in cross section. The fluid passage includes a throat portion smallest in cross-sectional area, a divergent portion that becomes larger in cross-sectional area toward a downstream side from the throat portion, and an ejection port that is provided at a downstream end of the divergent portion. A passage wall surface of the divergent portion includes a recess portion that is recessed from within outward in a radial direction of the passage wall surface. The recess portion is located adjacent to the ejection port, and the recess portion extends continuously in a circumferential direction
(Continued)

of the passage wall surface to enclose the fluid passage and have an annular shape. Accordingly, noise due to an expansion wave of the ejected fluid can be reduced.

8 Claims, 3 Drawing Sheets

(51) Int. Cl.
*F04F 5/50* (2006.01)
*F04F 5/16* (2006.01)
*F04F 5/24* (2006.01)

(52) U.S. Cl.
CPC ..... *F04F 5/463* (2013.01); *F04F 5/50* (2013.01); *Y10T 137/2224* (2015.04)

(56) References Cited

FOREIGN PATENT DOCUMENTS

| | | | |
|---|---|---|---|
| JP | 2001295800 | A | 10/2001 |
| JP | 2008303851 | A | 12/2008 |
| JP | 4760843 | B2 | 8/2011 |
| SU | 1511533 | A1 | 9/1989 |

OTHER PUBLICATIONS

Office Action dated Sep. 29, 2015 issued in the corresponding CN application No. 201380012936.X with English translation.
International Search Report and Written Opinion (in Japanese with English Translation) for PCT/JP2013/000965, mailed May 21, 2013; ISA/JP.

* cited by examiner

EJECTOR

CROSS REFERENCE TO RELATED APPLICATIONS

This application is a U.S. National Phase Application under 35 U.S.C. 371 of International Application No. PCT/JP2013/000965 filed on Feb. 21, 2013 and published in Japanese as WO 2013/132768 A1 on Sep. 12, 2013. This application is based on and claims the benefit of priority from Japanese Patent Application No. 2012-050830 filed on Mar. 7, 2012. The entire disclosures of all of the above applications are incorporated herein by reference.

TECHNICAL FIELD

The present disclosure relates to an ejector that is a momentum transport pump depressurizing a fluid and transporting the fluid by a suction action of a working fluid ejected at high speed.

BACKGROUND ART

An ejector shown in Patent Document 1, for example, is known as a conventional ejector. In the ejector of Patent Document 1, a nozzle includes a throat portion most-reduced in passage cross-sectional area, and a divergent portion enlarged in passage cross-sectional area toward a downstream side from the throat portion. The divergent portion has a middle part on an upstream side, and an outlet part on a downstream side.

A divergent angle θ1 of a passage wall surface of the middle part is configured to be constant within the middle part. A divergent angle θ2 of a passage wall surface of the outlet part is configured to be larger than the divergent angle θ1.

When the fluid flowing into the throat portion in a gas-liquid two-phase state is depressurized, a gas content in the fluid increases in accordance with the depressurizing in the outlet part, especially. In the ejector of Patent Document 1, the divergent angle θ2 of the outlet part is made to be larger than the divergent angle θ1 of the middle part in accordance with the increase of the gas content. Thus, a pace of expansion in passage cross-sectional area is larger in the outlet part than in the middle part. Therefore, the fluid can be easily accelerated in the divergent portion, and a nozzle efficiency can be improved steadily.

PRIOR ART DOCUMENT

Patent Document

Patent Document 1: Japanese Patent No. 4760843

SUMMARY OF THE INVENTION

However, according to a study of the inventors of the present application, in the ejector of Patent Document 1, when a flow rate of the fluid flowing into the ejector changes, for example, when the flow rate increases, the fluid ejected from the outlet part may be in an insufficiently expanded state.

It is an objective of the present disclosure to provide an ejector capable of reducing noise due to an expansion wave of ejected fluid.

According to a first aspect of the present disclosure, an ejector includes a nozzle that ejects a fluid, and the nozzle includes therein a fluid passage having a circular shape in cross section. The fluid passage includes a throat portion that is smallest in cross-sectional area and depressurizes the fluid flowing into the fluid passage, a divergent portion that becomes larger in cross-sectional area toward a downstream side from the throat portion in a flow direction of the fluid, and an ejection port that is provided at a downstream end of the divergent portion and is a port through which the fluid in the divergent portion is ejected. A passage wall surface of the divergent portion includes a recess portion that is recessed from within outward in a radial direction of the passage wall surface, and the recess portion is located adjacent to the ejection port. The recess portion extends continuously in a circumferential direction of the passage wall surface to have an annular shape.

Accordingly, the fluid depressurized in the throat portion is accelerated in the divergent portion and reaches the recess portion. Firstly, in an upstream part of the recess portion, a passage cross-sectional area increases from the passage wall surface toward a bottom part of the recess portion. Thus, the fluid at supersonic speed is accelerated and causes an expansion wave in the divergent portion. During this, a pressure of the fluid decreases. Next, in a downstream part of the recess portion, the passage cross-sectional area decreases from the bottom part of the recess portion toward the passage wall surface. Thus, the accelerated fluid is decelerated drastically and causes a shock wave. During this, the pressure of the fluid increases. Accordingly, generation of an expansion wave in an ejected flow jetted from the ejection port can be prevented, and the ejected flow can be kept near an appropriately expanded state or an excessively expanded state. Therefore, a noise caused by the ejected flow can be reduced.

According to a second aspect of the present disclosure, a shape of the recess portion in cross section perpendicular to a circumferential direction of the recess portion may be a V shape.

Accordingly, a pace of expansion in passage cross-sectional area of the upstream part of the recess portion and a pace of reduction in passage cross-sectional area of the downstream part of the recess portion can be made to be constant by making the sectional shape of the recess portion into the V shape. Hence, an acceleration effect of the fluid in the upstream part of the recess portion and a deceleration effect of the fluid in the downstream part of the recess portion can be obtained appropriately.

According to a third aspect of the present disclosure, the recess portion may be provided at a position from 5 to 10% of a length of the divergent portion in its axial direction away from the ejection port toward an upstream side in the fluid flow.

Accordingly, an effect of the recess portion can be produced while a basic flow of the fluid in the divergent portion is interfered as little as possible.

According to a fourth aspect of the present disclosure, the recess portion has a sectional shape perpendicular to a circumferential direction such that an angle of a recess corner part positioned at the bottom part of the recess portion becomes lower than an angle of a protrusion corner part positioned at a boundary between the passage wall surface and the recess portion.

EMBODIMENTS FOR EXPLOITATION OF THE INVENTION

Hereinafter, an embodiment for implementation of the present disclosure will be described with reference to the drawings.

Figure 1:
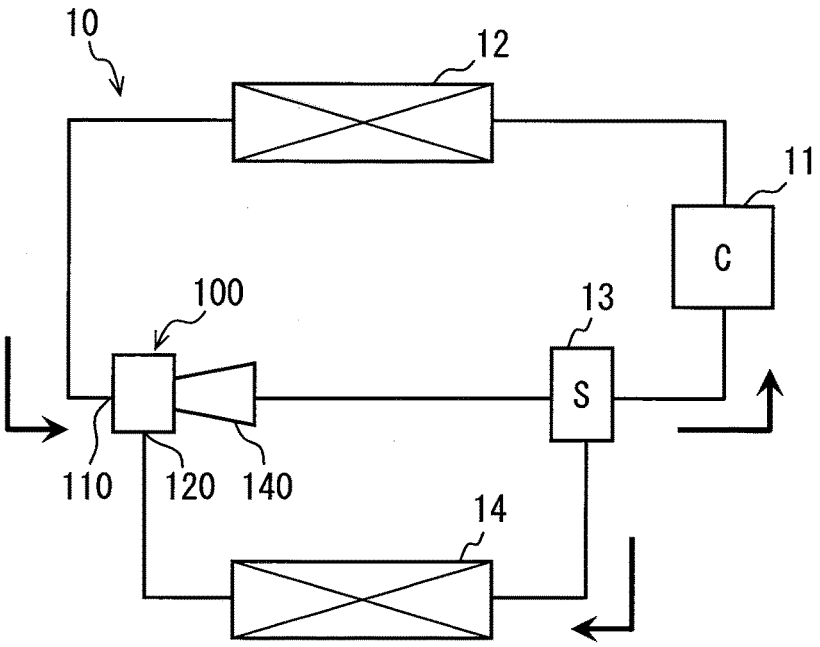
FIG. 1 is a schematic diagram showing a refrigeration cycle including an ejector according to an embodiment of the present disclosure.

In FIG. 1, an ejector 100 of the embodiment is used for a vapor-compression refrigeration cycle 10 (hereinafter, refrigeration cycle). The refrigeration cycle 10 is disposed in a vehicle for an air conditioner, in which a compressor 11, a condenser 12, the ejector 100, a gas-liquid separator 13 and an evaporator 14 are connected by a refrigerant pipe. An operation of the compressor 11 is controlled by a non-shown controller, and a refrigerant circulates in the refrigeration cycle 10. The refrigerant may be used as an example of a fluid flowing through the ejector 100.

The compressor 11 is a fluid machine that draws a gas refrigerant from the gas-liquid separator 13 and compresses the refrigerant into a high-pressure and high-temperature state, thereby discharging the refrigerant to the condenser 12. The compressor 11 is rotary-driven by a vehicle-running engine via an electromagnetic clutch and a belt that are not shown in the drawings. The compressor 11 is, for example, a swash-plate variable displacement compressor in that a discharge capacity is changed by input of a control signal from the controller to an electromagnetic capacity control valve. The compressor 11 may be an electric compressor that is rotary-driven by an electric motor. In the electric compressor, the discharge capacity is changed according to a rotation rate of the electric motor.

The condenser 12 is a heat exchanger in which a high pressure refrigerant discharged from the compressor 11 exchanges heat with a vehicle outside air (hereinafter, outside air) forcibly blown by a non-shown cooling fan. According to the heat exchange, the high pressure refrigerant releases heat to the outside air (is cooled), and the refrigerant is condensation-liquefied. When a pressure of the refrigerant compressed by the compressor 11 exceeds a critical pressure, the refrigerant is not condensation-liquefied even if the refrigerant is cooled. In this case, the condenser 12 functions as a radiator that cools the high pressure refrigerant. A refrigerant outflow side of the condenser 12 is connected to a nozzle portion 110 (described in detail later) of the ejector 100.

Figure 2:
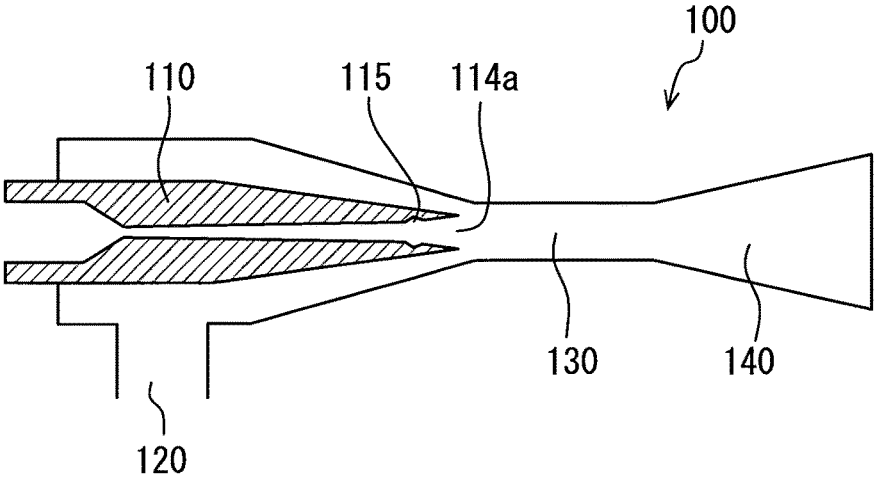
FIG. 2 is a schematic sectional diagram showing the ejector according to the embodiment.
Figure 3A:
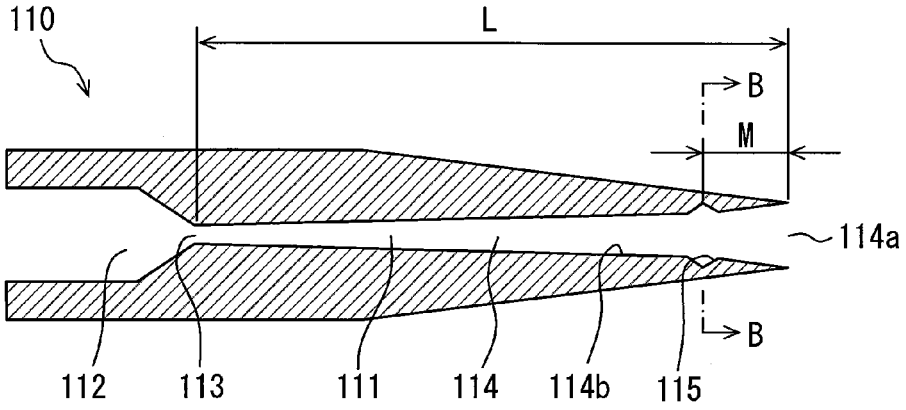
FIG. 3A is a sectional diagram showing a nozzle portion for the ejector according to the embodiment.

The ejector 100 is a depressurizing device that depressurizes liquid refrigerant (liquid fluid) flowing out of the condenser 12. The ejector 100 is also a fluid-transport refrigerant circulation device that circulates the refrigerant by a suction action (involving action) of a refrigerant flow jetting at high speed. As shown in FIGS. 2 and 3A, the ejector 100 includes the nozzle portion 110, a suction portion 120, a mixing portion 130 and a diffuser portion 140.

The nozzle portion 110 takes in the liquid refrigerant flowing out of the condenser 12, and depressurizes and expands the refrigerant by isentropically transforming a pressure energy of the refrigerant into a velocity energy through a passage that is reduced in cross-section toward a downstream side in a refrigerant flow. The nozzle portion 110 may be used as a nozzle that depressurizes a fluid. The nozzle portion 110 is made of a thin, long and cylindrical member, and has a refrigerant passage 111 that is circular in cross-section and extends along a center axis of the nozzle portion 110 in a center part of the nozzle portion 110. The refrigerant passage 111 may be used as a fluid passage through which a fluid flows. The nozzle portion 110 includes a convergent portion 112 in which the refrigerant passage 111 is tapered from an upstream end toward a downstream side, and a divergent portion 114 provided downstream of the convergent portion 112. In the divergent portion 114, the refrigerant passage 111 is enlarged toward the downstream side. A portion where the convergent portion 112 and the divergent portion 114 are connected is a nozzle throat portion 113 most-reduced in flow-channel area. The nozzle throat portion 113 may be used as an example of a throat portion where a passage cross sectional area is most-reduced in a middle of a fluid passage.

A downstream end of the divergent portion 114 is an ejection port 114*a* through which the refrigerant depressurized by the nozzle throat portion 113 and the divergent portion 114 into a gas-liquid two-phase state is ejected. An inner wall of the divergent portion 114 is a passage wall surface 114*b*. A recess portion 115 is provided on the passage wall surface 114*b*.

Figure 3B:
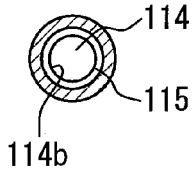
FIG. 3B is a sectional diagram taken along a line B-B of FIG. 3A.

The recess portion 115 is a groove extending in a circumferential direction of the passage wall surface 114*b*, and is ring-shaped groove fully continuous in the circumferential direction of the passage wall surface 114*b*. A sectional shape of the recess portion 115, perpendicular to the circumferential direction, is a V shape. The V shape has a larger dimension in width than in depth. The recess portion 115 is provided adjacent to the ejection port 114*a* in the divergent portion 114 (at a position of a dimension M in FIG. 3A). Specifically, when a length of the divergent portion 114 in its axial direction is defined as L, a position (dimension M) of the recess portion 115 in the divergent portion 114 is from 5 to 10% of the length L of the divergent portion 114 in the axial direction away from the ejection port 114*a* toward an upstream side in a refrigerant flow. As shown in FIG. 3B, the recess portion 115 extends continuously in the circumferential direction of the passage wall surface 114*b* and is provided into an annular shape.

The suction portion 120 is a passage extending in a direction intersecting with the nozzle portion 110 and is provided to communicate with the ejection port 114*a* of the nozzle portion 110 from outside the ejector 100. The suction portion 120 is connected to a refrigerant outflow side of the evaporator 14.

The mixing portion 130 is a passage provided downstream of the nozzle portion 110, in which a high-speed refrigerant ejected from the nozzle portion 110 (ejection port 114*a*) and a suction refrigerant drawn from the suction portion 120 (evaporator 14) are mixed, and the mixed refrigerant flows to the diffuser portion 140.

The diffuser portion 140 is a pressurizing portion that pressurizes the mixed refrigerant flowing out of the mixing portion 130 by decelerating the mixed refrigerant to transform a velocity energy into a pressure energy. The diffuser portion 140 has a shape (i.e. diffuser shape) gradually enlarged in flow-channel cross-sectional area toward the downstream side in the refrigerant flow, thereby having the above-described pressurizing function. The diffuser portion 140 is connected to the gas-liquid separator 13.

Return to FIG. 1, the gas-liquid separator 13 is a separator that separates the mixed refrigerant flowing out of the diffuser portion 140 of the ejector 100 into gas and liquid two phases. The gas-liquid separator 13 is provided integrally with a fluid storage portion that stores therein the gas and liquid refrigerants separated by the gas-liquid separator 13. A liquid refrigerant of the gas and liquid refrigerants separated by the gas-liquid separator 13 is accumulated in a lower part of the fluid storage portion, and a gas refrigerant of the gas and liquid refrigerants is accumulated in an upper part of the fluid storage portion. The part of the fluid storage portion where the liquid refrigerant is stored is connected to a refrigerant inflow side of the evaporator 14 by a refrigerant pipe. The part of the fluid storage portion where the gas refrigerant is stored is connected to a suction side of the compressor 11 by a refrigerant pipe.

The evaporator 14 is a heat exchanger where the liquid refrigerant flowing therethrough is evaporated by a heat absorption action of the outside air or a vehicle inside air (hereinafter, inside air) that is introduced into an air-conditioning casing of the air conditioner by a blower. A refrigerant outflow side of the evaporator 14 is connected to the suction portion 120 of the ejector 100 by a refrigerant pipe.

The non-shown controller includes a known microcomputer including CPU, ROM and RAM, and its peripheral circuit. A variety of operational signals from a control panel (not shown) for a passenger (e.g., from an air-conditioning activation switch or a temperature setting switch), and detection signals or the like from various sensors are input into the controller. The controller performs a variety of calculations and processing by using the input signals based on a control program stored in the ROM, thereby controlling operations of various devices (the compressor 11 mainly in the embodiment).

Next, operational effects of the embodiment based on the above-described configurations will be described.

When the passenger operates, for example, the air-conditioning activation switch or the temperature setting switch, a control signal output from the controller is transferred electrically to an electromagnetic clutch of the compressor 11 and the electromagnetic clutch becomes connected. Hence, a rotation driving force is transmitted to the compressor 11 from the vehicle-running engine. When the compressor 11 is an electric compressor, an electric motor is driven, and a rotation driving force is transmitted to the compressor 11 from the electric motor.

When the controller outputs a control current In (control signal) to the electromagnetic capacity control valve of the compressor 11 based on the control program, a discharge capacity of the compressor 11 is adjusted. The compressor 11 draws a gas refrigerant from the fluid storage portion and compresses and discharges the refrigerant.

A high pressure gas refrigerant compressed by and discharged from the compressor 11 flows into the condenser 12. In the condenser 12, the high-temperature and high-pressure refrigerant is cooled by the outside air to be condensed and liquefied. A liquid refrigerant flowing out of the condenser 12 flows into the nozzle portion 110 (convergent portion 112) of the ejector 100.

In the nozzle portion 110, the refrigerant is depressurized and expanded by the convergent portion 112, the nozzle throat portion 113 and the divergent portion 114 into a gas-liquid two-phase state. Since a pressure energy of the refrigerant is transformed into a velocity energy during the depressurization and expansion, the gas-liquid two-phase refrigerant is ejected from the ejection port 114*a* at high speed. A refrigerant suction action of the ejected refrigerant flow causes a liquid refrigerant in the gas-liquid separator 13 to flow through the evaporator 14 and become a gas refrigerant and to be drawn into the suction portion 120.

The gas-liquid two-phase refrigerant ejected from the ejection port 114*a* and the gas refrigerant drawn into the suction portion 120 are mixed in the mixing portion 130 located downstream of the nozzle portion 110. The mixed refrigerant flows into the diffuser portion 140. In the diffuser portion 140, a pressure of the refrigerant is increased because a velocity energy of the refrigerant is transformed into a pressure energy through a passage that is enlarged in passage area toward a downstream side.

The refrigerant flowing out of the diffuser portion 140 flows into the gas-liquid separator 13. The gas and liquid refrigerants separated by the gas-liquid separator 13 flows into the fluid storage portion. The gas refrigerant in the fluid storage portion is drawn into the compressor 11 and compressed newly. Since a pressure of the refrigerant drawn into the compressor 11 is increased in the diffuser portion 140 of the ejector 100, a driving power of the compressor 11 can be reduced.

The liquid refrigerant of the gas and liquid refrigerants separated by the gas-liquid separator 13 made to flow into the evaporator 14 from the fluid storage portion by a refrigerant suction action of the ejector 100. In the evaporator 14, a low pressure refrigerant absorbs heat from air (outside air or inside air) in the air-conditioning casing and evaporates. That is, the air in the air-conditioning casing is cooled. The gas refrigerant after passing through the evaporator 14 is drawn into the ejector 100, and flows out of the diffuser portion 140.

Figure 4:
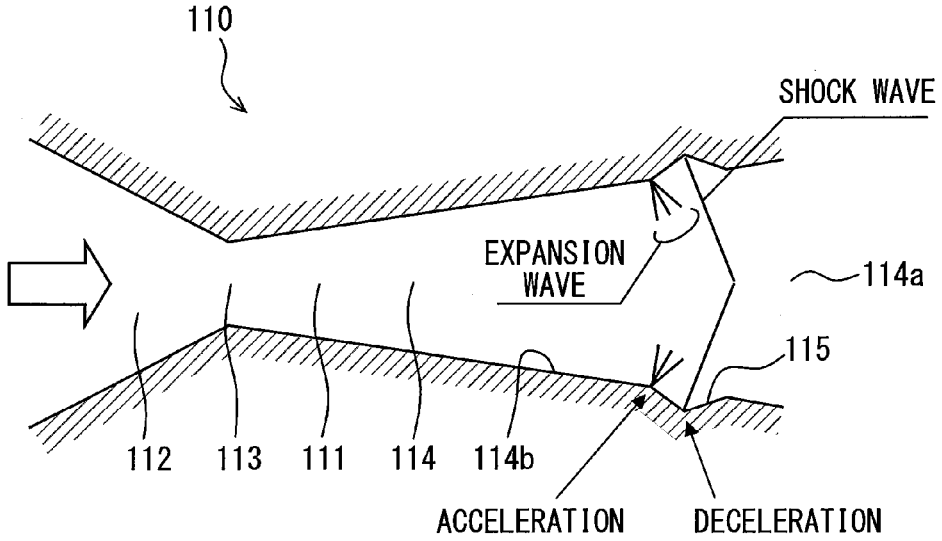
FIG. 4 is a schematic diagram showing a flow of fluid in the nozzle portion for the ejector according to the embodiment.
Figure 5:
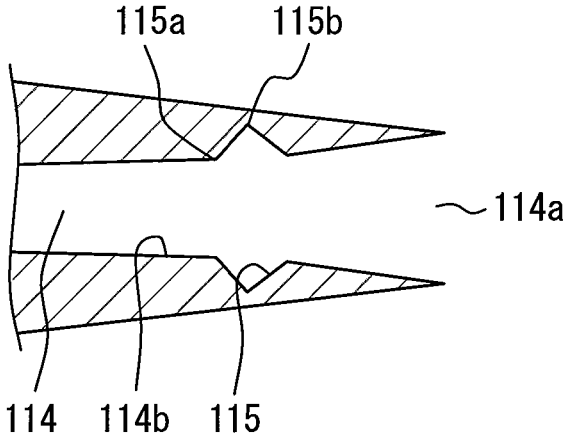
FIG. 5 is a schematic diagram showing a downstream end part of the nozzle portion in a flow direction of the fluid, for the ejector according to the embodiment.

In the present embodiment, the recess portion 115 is provided in the divergent portion 114. As shown in FIG. 4, the refrigerant depressurized in the nozzle throat portion 113 is accelerated in the divergent portion 114 to a supersonic speed and reaches the recess portion 115. In an upstream part of the recess portion 115, firstly, a passage cross-sectional area is enlarged from the passage wall surface 114*b* toward a bottom part of the recess portion 115. Thus, the supersonic refrigerant is accelerated and causes an expansion wave in the divergent portion 114. During this, a pressure of the refrigerant decreases. Next, in a downstream part of the recess portion 115, the passage cross-sectional area is reduced from the bottom part of the recess portion 115 toward the passage wall surface 114*b*. Thus, the accelerated refrigerant is drastically decelerated and causes a shock wave. During this, the pressure of the refrigerant increases. Accordingly, generation of an expansion wave in an ejected flow out of the ejection port 114*a* can be prevented. Therefore, the ejected flow can be kept near an appropriately expanded state or an excessively expanded state, and a noise due to the ejected flow can be reduced.

Since the sectional shape of the recess portion 115, perpendicular to the circumferential direction, is made to be the V shape, a pace of expansion in passage cross-sectional area of the upstream part of the recess portion 115 and a pace of reduction in passage cross-sectional area of the downstream part of the recess portion 115 can be made to be constant. Hence, an acceleration effect of the refrigerant in the upstream part of the recess portion 115 and a deceleration effect of the refrigerant in the downstream part of the recess portion 115 can be obtained appropriately.

Since the position of the recess portion 115 is set at a position from 5 to 10% of the length L of the divergent portion 114 in the axial direction away from the ejection port

114*a* toward the upstream side and is thus adjacent to the ejection port 114*a*, an effect of the recess portion 115 as described above can be produced while a basic flow of the fluid in the divergent portion 114 is interfered as little as possible.

While the preferable embodiment of the present disclosure is described above, the present disclosure is not limited to the above-described embodiment and can be implemented with being changed variously without departing from the scope of the present disclosure.

An angle of a recess corner part 115*b* positioned at the bottom part of the recess portion 115 may be smaller than an angle of a protrusion corner part 115*a* positioned at a boundary between the passage wall surface 114*b* and the recess portion 115. Accordingly, the refrigerant is capable of reducing generation of the shock wave more in the protrusion corner part 115*a* positioned at the boundary between the passage wall surface 114*b* and the recess portion 115 than in the recess corner part 115*b* positioned at the bottom part of the recess portion 115. Hence, the refrigerant can be accelerated toward the bottom part of the recess portion 115 without loss of energy of the supersonic refrigerant. Since the accelerated flow from the passage wall surface 114*b* to the bottom part of the recess portion 115 is drastically decelerated from the bottom part of the recess portion 115 to the passage wall surface 114*b*, the shock wave can be generated efficiently. By adopting such configuration, the noise due to the ejected flow can be further reduced more effectively. Moreover, an angle of the protrusion corner part 115*a* located downstream of the recess portion 115 may be smaller than an angle of the protrusion corner part 115*a* located upstream of the recess portion 115. Alternatively, an angle of the protrusion corner part 115*a* located upstream of the recess portion 115 may be smaller than an angle of the protrusion corner part 115*a* located downstream of the recess portion 115.

In the above-described embodiment, the sectional shape of the recess portion 115 provided in the divergent portion 114 is the V shape but is not limited. the sectional shape of the recess portion 115 may be a U shape.

The high pressure refrigerant flowing into the nozzle portion 110 is a liquid refrigerant but is not limited. The refrigerant may be a gas-liquid two phase refrigerant.

The refrigeration cycle 10 in which the ejector 100 is used is not limited to that of the above-described embodiment. The refrigeration cycle 10 may include two evaporators, and a refrigerant flowing out of the diffuser portion 140 may be made to flow into a first evaporator, a part of a refrigerant flowing out of the condenser may be made to flow into a second evaporator, and the refrigerant flowing out of the second evaporator may be drawn into the suction portion 120. Alternatively, a refrigerant flowing out of the diffuser portion 140 may be made to flow into the compressor, a part of a refrigerant flowing out of the condenser may be depressurized and be made subsequently to flow into the evaporator, and a refrigerant flowing out of the evaporator may be drawn into the suction portion 120.

The refrigeration cycle 10 of the above-described embodiment can be applied to a vehicular refrigerator or a heat pump cycle for a household water heater or an interior air conditioner, alternatively for the vehicular air conditioner as described above.

In the above-described embodiment, a type of the refrigerant is not specified, but may be a fluorocarbon refrigerant, a hydrocarbon refrigerant or a carbon dioxide refrigerant. The refrigerant can be applied to a supercritical cycle or a subcritical cycle in addition to the normal cycle.

The invention claimed is:

1. An ejector comprising:

a nozzle that ejects a fluid, wherein the nozzle includes therein a fluid passage having a circular shape in cross section, the fluid passage includes:

a throat portion that is smallest in cross-sectional area of the fluid passage, wherein the fluid is depressurized downstream thereof;

a divergent portion that becomes larger in cross-sectional area toward a downstream end from the throat portion in a flow direction of the fluid; and an ejection port that is provided at the downstream end of the divergent portion and is a port through which the fluid in the divergent portion is ejected, a passage wall surface of the divergent portion includes a recess portion that is recessed from within outward in a radial direction of the passage wall surface, a first uninterrupted surface extending between the throat portion and the recess portion, and a second uninterrupted surface extending from the recess portion to the election port, the recess portion is located adjacent to the ejection port, the recess portion extends continuously in a circumferential direction of the passage wall surface to have an annular shape, a shape of the recess portion in cross section perpendicular to the circumferential direction is a V shape, and the V shape has a larger dimension in width along the flow direction than depth.

2. The ejector according to claim 1, wherein the recess portion is provided at a position from 5 to 10% of a length of the divergent portion in its flow direction away from the ejection port toward the throat portion of the fluid.

3. The ejector according to claim 1, wherein the recess portion has a sectional shape perpendicular to the circumferential direction such that an angle of a recess corner part positioned at a bottom part of the recess portion is smaller than an angle of a protrusion corner part positioned at a boundary between the passage wall surface and the recess portion.

4. The ejector according to claim 1, wherein the first uninterrupted surface of the divergent portion includes a conical surface and the recess portion is recessed from the conical surface in the radial direction.

5. An ejector comprising:

a nozzle that ejects a fluid, wherein the nozzle includes therein a fluid passage having a circular shape in cross section, the fluid passage includes:

a throat portion that is smallest in cross-sectional area of the fluid passage, wherein the fluid is depressurized downstream thereof;

a divergent portion that becomes larger in cross-sectional area toward a downstream end from the throat portion in a flow direction of the fluid; and an ejection port that is provided at the downstream end of the divergent portion and is a port through which the fluid in the divergent portion is ejected, a passage wall surface of the divergent portion includes a recess portion that is recessed from within outward in a radial direction of the passage wall surface, a first uninterrupted surface extending between the throat portion and the recess portion, and a second uninterrupted surface extending from the recess portion to the ejection port, the recess portion is located adjacent to the ejection port, the recess portion extends continuously in a circumferential direction of the passage wall surface to have an annular shape, and a shape of the recess portion in cross section perpendicular to the circumferential direction is a V shape.

6. The ejector according to claim 5, wherein the recess portion is provided at a position from 5 to 10% of a length of the divergent portion in its flow direction away from the ejection port toward the throat portion of the fluid.

7. The ejector according to claim 5, wherein the recess portion has a sectional shape perpendicular to the circumferential direction such that an angle of a recess corner part positioned at a bottom part of the recess portion is smaller than an angle of a protrusion corner part positioned at a boundary between the passage wall surface and the recess portion.

8. The ejector according to claim 5, wherein the first uninterrupted surface of the divergent portion includes a conical surface and the recess portion is recessed from the conical surface in the radial direction.

* * * * *